US005423377A

United States Patent [19]

Iwata et al.

[11] Patent Number: 5,423,377

[45] Date of Patent: Jun. 13, 1995

[54] CONDENSER FOR A STEAM TURBINE AND A METHOD OF OPERATING SUCH A CONDENSER

[75] Inventors: Kazuya Iwata; Yoosyun Horibe; Yoshio Sumiya, all of Hitachi; Ryoichi Ohkura, Takahagi, all of Japan

[73] Assignee: Hitachi, Ltd., Tokyo, Japan

[21] Appl. No.: 114,628

[22] Filed: Sep. 2, 1993

[30] Foreign Application Priority Data

Sep. 10, 1992 [JP] Japan ..... 4-241676

[51] Int. Cl.[6] ..... F28B 9/08

[52] U.S. Cl. ..... 165/112; 165/110

[58] Field of Search ..... 165/110, 112, 113

[56] References Cited

U.S. PATENT DOCUMENTS

| | | | |
|---|---|---|---|
| 2,542,873 | 2/1951 | Karr | 165/113 |
| 2,663,547 | 12/1953 | Evans, Jr. et al. | 165/112 X |
| 2,916,260 | 12/1959 | Worn et al. | 165/114 |
| 2,939,685 | 6/1960 | Worn et al. | 165/114 |
| 2,946,571 | 7/1960 | Droescher et al. | 257/43 |
| 3,429,371 | 2/1969 | Palmer et al. | 165/112 |
| 3,698,476 | 10/1972 | Wyzalek et al. | 165/112 |
| 4,598,767 | 7/1986 | Saleh | 165/113 |
| 5,095,706 | 3/1992 | Saito et al. | 60/646 |

FOREIGN PATENT DOCUMENTS

| | | | |
|---|---|---|---|
| 0134457 | 3/1985 | European Pat. Off. . | |
| 0152920 | 8/1985 | European Pat. Off. . | |
| 1939606 | 2/1970 | Germany . | |
| 57-131984 | 8/1982 | Japan . | |
| 58-217707 | 12/1983 | Japan . | |
| 61280387 | 12/1983 | Japan . | |
| 59-3106 | 1/1984 | Japan . | |
| 59-153094 | 8/1984 | Japan . | |
| 60-114693 | 6/1985 | Japan | 165/112 |
| 3275905 | 12/1991 | Japan . | |

*Primary Examiner*—Allen J. Flanigan

*Attorney, Agent, or Firm*—Antonelli, Terry, Stout & Kraus

[57] ABSTRACT

In the operation of a main steam condenser of a steam turbine driven by a boiler and having a gland steam condenser, the gland steam condensate is normally fed from the gland steam condenser into the main condenser condensate. To avoid contamination of the main condenser condensate by oxygen-rich water, for at least part of the start-up period of the turbine, the gland steam condensate and other drain accumulating in the condenser is prevented from entering the main condenser condensate which is to be fed to the boiler. The gland steam condensate is fed to said main condenser and stored in a reservoir separate from the hot well thereof, to undergo de-aeration before being fed into the main condenser condensate.

8 Claims, 8 Drawing Sheets

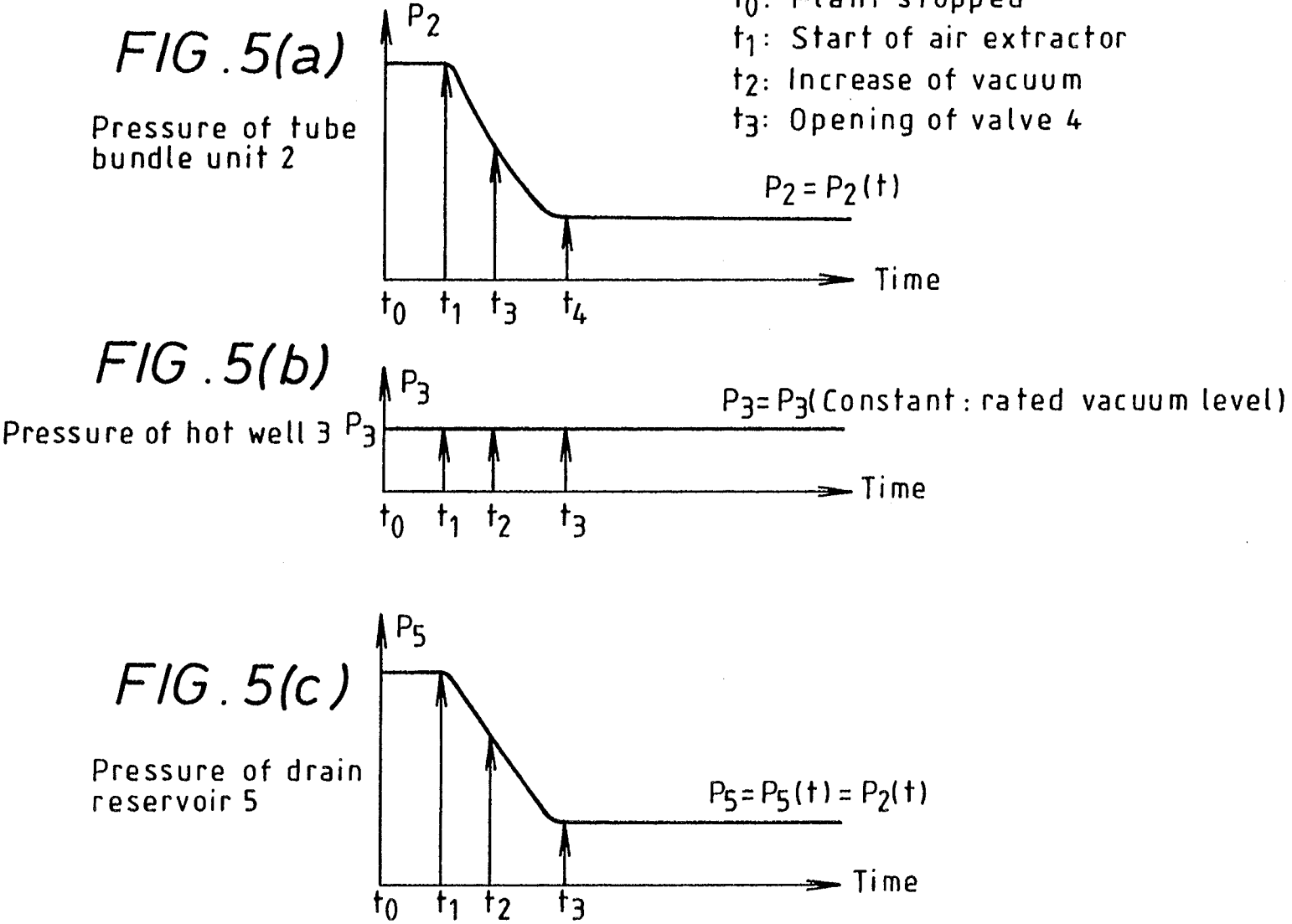
FIG. 5(a) Pressure of tube bundle unit 2
FIG. 5(b) Pressure of hot well 3 $P_3$
FIG. 5(c) Pressure of drain reservoir 5

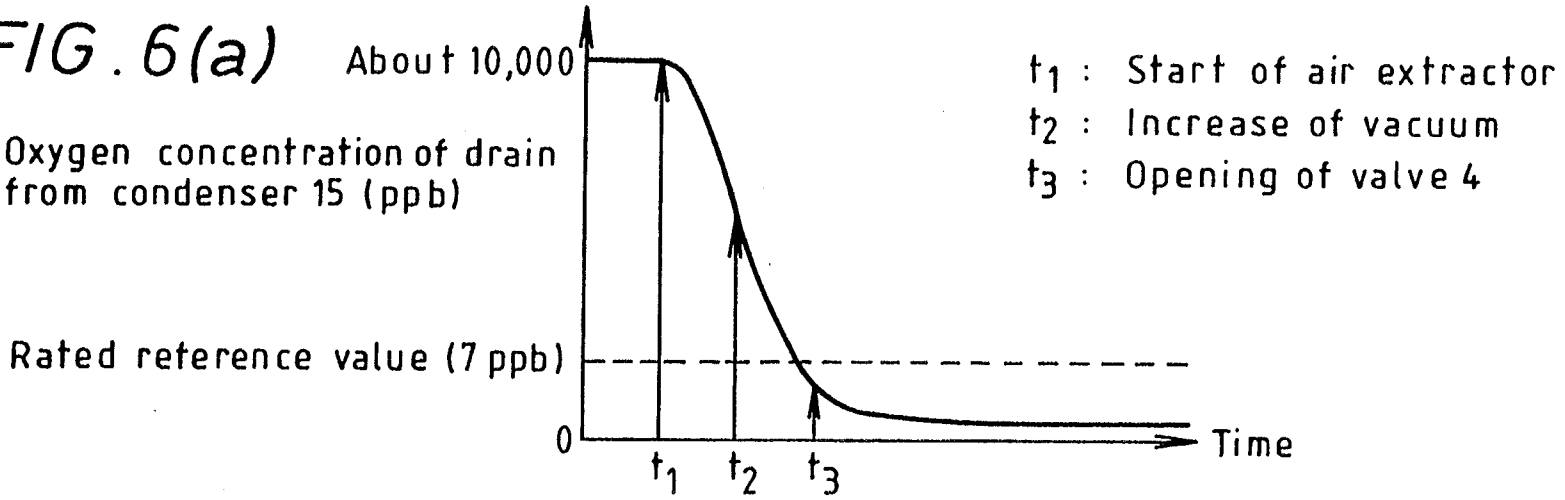
FIG. 6(a)
About 10,000
Oxygen concentration of drain from condenser 15 (ppb)
Rated reference value (7 ppb)
0
$t_1$
$t_2$
$t_3$
Time
$t_1$ : Start of air extractor
$t_2$ : Increase of vacuum
$t_3$ : Opening of valve 4

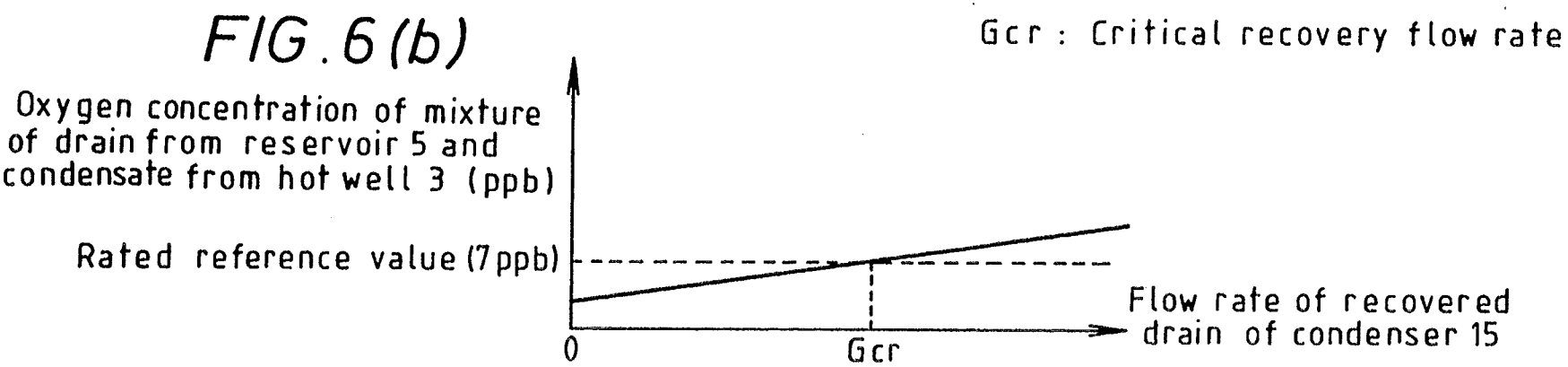
FIG. 6(b)
Oxygen concentration of mixture of drain from reservoir 5 and condensate from hot well 3 (ppb)
Rated reference value (7ppb)
0
Gcr
Flow rate of recovered drain of condenser 15
Gcr : Critical recovery flow rate

CONDENSER FOR A STEAM TURBINE AND A METHOD OF OPERATING SUCH A CONDENSER

BACKGROUND OF THE INVENTION

1. Field of the Invention

This invention relates to a condenser and a method of operating a main steam condenser of a steam turbine driven by steam from a boiler, with condensate in the main condenser being fed to the boiler.

2. Description of the Prior Art

A main steam condenser having an isolatable condenser hot well unit is proposed in JP-A-2-95704 and is illustrated in FIG. 8 of the drawings of this application. The condenser includes a tube bundle 28 in a tube bundle unit 2 comprising condensing tubes for cooling and condensing the steam turbine exhaust steam with sea water or the like, and a hot well unit 3 for storing the condensate, isolated by a condenser partition 7 having a shut-off valve 4. The shut-off valve 4, disposed in the partition 7, is open in normal running so that the water condensed in the tube bundle unit 2 is stored in the hot well unit until it is fed to the boiler. When the operation of the condenser is interrupted, the shut-off valve 4 is closed to leave only the tube bundle unit 2 open to the atmosphere so as to prevent the condensate in the hot well unit from deteriorating by oxygen or the like dissolved in the condensate during the interruption of the operation of the condenser. At start-up of the plant, the drainage stored in the tube bundle unit during the interruption is discharged to outside via a drainage pipe 9 having a valve 10 and vacuum in the tube bundle unit 2 is raised by an air extractor 17 in a line 18. The shut-off valve 4 is opened to connect the tube bundle unit 2 and the hot well unit 3 when their pressures are substantially equal to each other.

The partition-type condenser of this construction is being widely adopted in a combined cycle plant for daily start-stop (DSS) operation in which the condenser is started and stopped every day so that it may be used a daytime power source. By the start-up method described and the condenser used therefor, the plant can be started for a short time period and with power economy.

As mentioned, the drainage accumulated on the condenser partition 7 while the condenser operation is interrupted can be discharged to the outside of the condenser, but no consideration is made for the treatment of the drainage which is generated at the start-up to the plant. Specifically, the drainage generated during the period or interruption of operation when the condenser is open to the atmosphere contains a considerable amount of oxygen, so that the drainage cannot be mixed with the condensate in the hot well unit. Therefore, the drainage which is accumulated on the condenser partition during the stop period of the condenser is discharged to the outside of the condenser. On the other hand, the drainage generated at the initial stage of the plant start-up has low quality, but in a later period has a high quality. Thus, it is effective for economical plant operation to recover those two types of drainage to the condenser, but this has not been considered in the prior art.

Incidentally, according to the prior art, the drainage accumulated in the condenser tube bundle unit 2 at the start may be mixed directly into the hot well unit 3 by opening the shut-off valve at an early stage after the start. However, since the drainage at this stage contains considerable amount of oxygen, the quality of the condensate water after the mixing highly departs from the required value for the boiler supply water so that hot well condensate 29 has to be de-aerated.

It is also conceivable to recover the drainage during the start-up to the outside of the condenser. However, discharging drainage in this way while raising the vacuum requires a powered drainage discharger for discharging it to atmospheric pressure, because the pressure of a tube bundle unit 2 of the condenser 1 is negative. If such a drainage discharger is used, ambient air may flow back into the condenser 1 to obstruct or delay the rise of the vacuum in the condenser.

A further matter which is given little consideration in the prior art is recovery of the condensate of turbine gland seal steam. When a turbine has a steam gland, the gland seal steam discharged from the steam gland may be condensed in a gland steam condenser 15. Steam is fed to this condenser 15 via line 21. The heat exchange is effected in condenser 15 by main steam condensate from the hot well 3, which may be recirculated directly to the hot well via line 16. The destination of gland steam condensate from the condenser 15 is not mentioned.

JP-A-4-112903 proposes a turbine steam condenser system in which the gland steam condensate is returned directly into the hot well. There is no partition in this case between the hot well and the tube bundle unit and the proposed method is disadvantageous in that it is now appreciated that initially at start-up of the turbine, the gland steam has a high oxygen content, so that its condensate is unsuitable to be fed into the main steam condensate, for re-feeding to the boiler.

U.S. Pat. No. 5,095,706 proposes a partition between the hot well and the tube bundle unit similar to JP-A-2-95704.

SUMMARY OF THE INVENTION

An object of the present invention is to provide a condenser for a steam turbine and a method of operation of the condenser, which makes it possible to operate the plant economically and to minimize the time period for starting the condenser while recovering the drainage to the condenser at a start-up of the steam turbine.

Another object of the invention is to make it possible to recover, at least partially, the gland seal steam, without deteriorating the quality of the circulating water.

According to the invention, there is provided a method of operating a main steam condenser of a steam turbine driven by a boiler and having a gland steam condenser, in which, after start-up of the turbine, the gland steam condensate is fed from said gland steam condenser into the main condenser condensate. The method is characterized by the step of, for at least part of the start-up period of the turbine, preventing the gland steam condensate from entering the main condenser condensate to be fed to the boiler. In this way deterioration of the quality of the main condensate is avoided or minimized during start-up.

During at least part of the start-up period, the gland steam condensate may be discharged from the circulating flows of water, i.e. outside the condenser system. Alternatively, to reduce loss of water, during at least part of the start-up period, the gland steam condensate is fed to the main condenser and stored in a reservoir thereof separate from the hot well, and undergoes de-aeration before being fed into the main condenser condensate to be fed to the boiler.

In another aspect, the invention provides a method of operating a main condenser of a steam turbine driven by steam from a boiler, which main condenser has a tube bundle and a hot well, comprising the steps of:

(i) during start-up of the turbine, storing a body of drainage formed by condensation of steam and having a relatively high oxygen content in a de-aeration region separated from the hot well;

(ii) starting a flow of drainage from the tube bundle to the hot well by-passing the de-aeration region;

(iii) after step (ii) and after reduction of the oxygen concentration of the body of drainage in the de-aeration region, feeding the body of drainage to the boiler.

This method allows full recovery of drainage generated before and during start-up and avoids or minimizes its effect on water quality.

The drainage having a relatively high oxygen content in the de-aeration region may be de-aerated by maintaining the de-aeration region at substantially the same pressure as a space containing the tube bundle. The drainage having a relatively high oxygen content may be at least partly condensate from a gland steam condenser.

The invention also provides a method of operating a main condenser of a steam turbine driven by steam from a boiler and having a gland steam condenser, the main condenser having a tube bundle for condensation of steam from the steam turbine and a hot well for accumulation of drainage from said tube bundle, in which condensate from the gland steam condenser is fed to the main condenser. The method is characterized by the step of, during a start-up period of the turbine, storing the condensate from the gland steam condenser in a reservoir separated from the hot well, until the oxygen content of the condensate flowing from the gland steam condenser has fallen below a predetermined level.

In yet another aspect, the invention provides a condenser for condensing the driving steam of a steam turbine, having:

a) a tube bundle for condensing the driving steam by heat exchange;

b) a drainage region below the tube bundle;

c) a hot well for holding the condensate of the driving steam from the tube bundle;

d) means for feeding the condensate from said hot well to a steam generator for the turbine;

e) a reservoir separated from the hot well for holding a body of drainage from the drainage region; and f) means for establishing flow of drainage from the drainage region to the hot well and the reservoir selectively and for pressure-isolating the hot well from said drainage region.

The means for selectively establishing flow and pressure isolating preferably comprises a conduit for flow of drainage from the drainage region to the hot well by-passing the reservoir and valve means for closing the conduit.

The reservoir is preferably arranged above the hot well and separated from the drainage region by a partition.

The reservoir is preferably connected to the drainage region by an air flow passage for maintaining the reservoir and the drainage region at substantially equal pressures.

For re-introducing the drainage in the reservoir to the circulatory flow, the condenser preferably has a conduit for flow of drainage from the reservoir to the hot well and valve means for controlling flow therein. Alternatively, means are provided for controlled feeding of a flow of drainage from the reservoir to the steam generator. The invention also provides a condenser for condensing the driving steam of a steam turbine, having:

a) a tube bundle for condensing the driving steam by heat exchange;

b) a drainage region below the tube bundle;

c) a hot well for holding the condensate of the driving steam from the tube bundle;

d) means for feeding the condensate from the hot well to a steam generator for the turbine;

e) a reservoir separated from the hot well for holding a body of drainage from the drainage region;

f) a gland steam condenser for condensing gland steam from a steam gland of the steam turbine; and g) a conduit for feeding gland steam condensate from the gland steam condenser to the drainage region.

Thus the invention can provide a condenser for a steam turbine having a main steam condenser for condensing driving steam of the turbine, a gland steam condenser for condensing gland steam from a steam gland of the turbine, and means for selectively feeding steam condensate from the gland steam condenser into the main condenser condensate and preventing gland steam condensate from entering the main condenser condensate.

The invention further provides a condenser for a steam turbine driven by steam from a boiler, which condenser has a tube bundle for condensation of driving steam of the turbine, a drainage region below the tube bundle, a hot well for accumulation of condensate from the tube bundle, a de-aeration region separated from the hot well for storing a body of drainage formed by condensation of steam, means for establishing a flow of drainage from the tube bundle to the hot well by-passing the de-aeration region, and means for feeding the body of drainage from the de-aeration region to one of the hot well and the boiler.

BRIEF DESCRIPTION OF THE DRAWINGS

Embodiments of the invention will now be described by way of non-limitative example, with reference to the accompanying drawings, in which:

FIGS. 5(*a*), 5(*b*) and 5(*c*) are graphical illustrations of pressure changes in regions of the condenser of FIG. 3 during the turbine start-up period;

FIGS. 6(*a*) and 6(*b*) are graphical illustrations of effects of the control method of the invention;

DESCRIPTION OF THE PREFERRED EMBODIMENTS

Figure 1:
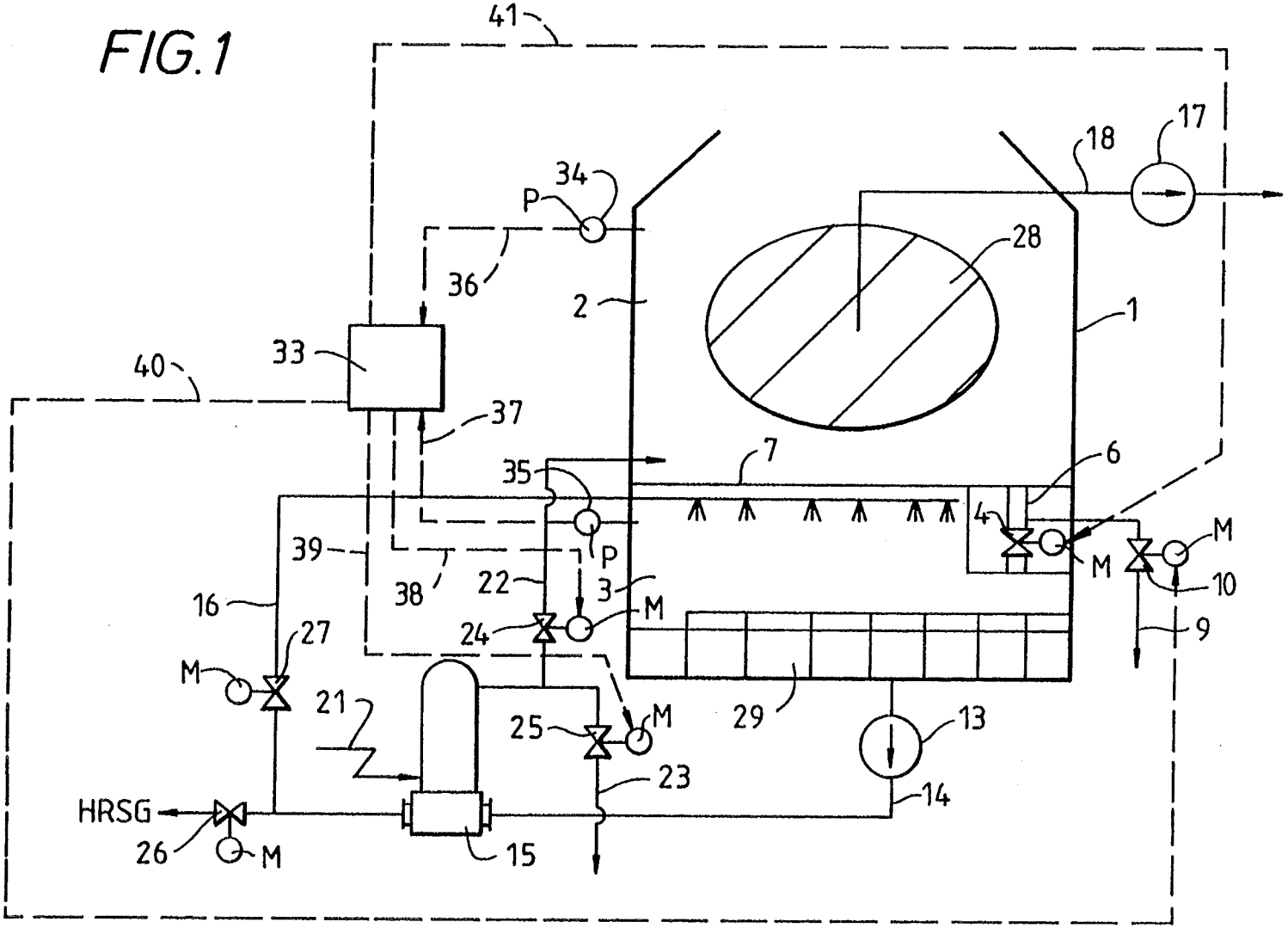
FIG. 1 is a diagrammatic view of a first condenser for a steam turbine plant, embodying the invention.

As shown in FIG. 1, turbine exhaust steam is introduced from the steam turbine (not shown) via an exhaust conduit (not shown) into a main steam condenser 1 from above and is cooled and condensed into condensate by sea water in a cooling tube bundle 28. The condensate is stored, in an amount corresponding to about five minutes of its rated flow rate considering load fluctuations, in a hot well 29 and is fed by a condensed water feeder 13 through a boiler water supply line 14, a gland steam condenser 15 and a change-over valve 26 to a steam generator such as a waste heat recovery boiler HRSG. The steam generated by this steam generator is fed to the aforementioned turbine. In ordinary or normal running mode, the steam and the water circulate by this route.

In the present invention, the main condenser 1 is partitioned into a tube bundle unit 2 and a hot well unit 3 by a partition 7, and these are connected by a downcomer 6 having a shut-off unit or valve 4. The shut-off unit 4 is closed, when the plant is to be stopped, so that the vacuum in the tube bundle unit 2 can be broken to stop the plant while the hot well unit 3 is maintained under a vacuum. As a result, the hot well unit 3 is maintained out of contact with the air during a stop period so that the hot well 29 maintains the condensate in a satisfactory quality for the running operation. During the stop period, a drainage shut-off valve 10 is left open, and the drainage present in the tube bundle unit 2 during the stop is discharged from above the partition 7 via a drainage pipe 9.

At the re-start of the plant, e.g. the next day, cooling water is fed first into the cooling tube bundle 28 by a cooling water feeder (not shown). The vacuum in the condenser 1 is then established. Prior to this, a turbine steam gland unit (not shown) must be sealed to prevent ambient air from flowing into the condenser 1 via the turbine gland. For this purpose, gland seal steam passing from the turbine gland is introduced via a gland steam line 21 into the gland steam condenser 15 so that the gland seal steam is cooled and condensed. The condensate water reserved in the condenser hot well 29 is used for cooling and condensing in the gland steam condenser 15.

After the start of the gland steam condenser 15, the turbine gland unit can thus be sealed by feeding the gland seal steam to the turbine gland unit.

The condensate used for the cooling and condensation in the gland steam condenser 15 is not fed to the HRSG in the preparation for starting the HRSG but is recirculated to the condenser 1 through a condensate recirculation line 16. This is because, if the HRSG is fed with this water, the amount of water in the condenser hot well 29 decreases with the consequence being that supply water which is oxygen-rich is fed to the condenser 1 to maintain the water level. This water supply during the start-up would deteriorate the quality of the condensed water, lengthening the start-up period. Therefore, the change-over valve 26 is closed and the change-over valve 27 is opened to recirculate the condensate directly to the hot well unit 3 of the condenser 1 to thereby continue the water supply to the cooling tubes in the gland steam condenser 15.

Incidentally, recirculation of this condensate used to condense the gland steam in the condenser 15 to the tube bundle unit 2 cannot be adopted because of many disadvantages. The first disadvantage is that the tube bundle unit 2 itself is not in a vacuum, resulting in possible deterioration of the quality of the condensate introduced. The second disadvantage is that the lowering of the water level of the hot well unit 3 cannot be prevented merely by the introduction of condensate into the tube bundle unit 2, thereby risking the deterioration of the water quality and the lengthening of the start-up due to the introduction of oxygen-rich supply water. Thus, if the condensate in the tube bundle unit 2 is introduced into the hot well unit 3 by :some means, the vacuum in the hot well unit 3 is broken, allowing oxygen to dissolve in the condensate in the hot well 29, deteriorating the quality of the condensate. Therefore, in the condenser 1 in which the good quality condensate satisfying water quality requirements is reserved in the hot well 29 by shutting off the hot well in order to reduce the start-up time the next day and to save auxiliary power required for the start-up, it is very advantageous to introduce this recirculated condensate directly into the hot well unit 3.

A combined cycle plant for the DSS run, as in the present embodiment, has a simple system construction and easy control because the amount of drainage generated in the plant system is smaller than that of the conventional fossil fuel plant. In order to reduce the capacity of the equipment, it is preferable to recover the drainage condensed by the gland steam condenser 15 to the tube bundle unit 2 of the condenser 1. During a normal running, this drainage passes via the downcomer 6 and the shut-off unit 4 to the hot well unit 3. At start-up, on the contrary, when the tube bundle unit 2 is under little or no vacuum, this drainage is introduced via a change-over valve 24 and a drainage recovery line 22 into the tube bundle unit 2 of the condenser 1 by making use of the pressure difference and the head difference but no power, and is discharged by gravity to the outside of the condenser 1 via the drainage pipe 9 branching from the down-comer 6 and the drainage shut-off valve 10.

FIG. 6(*a*) plots the oxygen concentration of this drainage from the gland steam condenser introduced into the condenser 1 during the start-up. The drainage concentration is about 10,000 (ppb) just after the start. When an air extractor for the condenser 1 operates (see below) after the start, the oxygen concentration falls to the rated reference value of 7 (ppb) before long. When a considerable time has lapsed after the start so that a high vacuum prevails in the tube bundle unit 2, as shown in FIG. 6(*a*), the drainage introduced into the tube bundle unit 2 has its oxygen concentration reduced by the evacuation so that mixing it with the condensate in the hot well 29 raises no problem. If, however, this drainage is mixed with the condensate in the hot well 29 when the tube bundle unit 2 is under a low vacuum, mixing it with the condensate in the hot well 29 would deteriorate the satisfactory water quality intended by the partition structure 7.

After the preparation for raising the vacuum of the condenser 1 has thus been completed, the air extractor 17 in an air extracting line 18 is started. When the air extractor 17 is started, the drainage residing on the partition 7 cannot be discharged by gravity because the pressure in the tube bundle unit 2 is negative. If air is suctioned via the drainage pipe 9, the vacuum raising rate of the tube bundle unit 2 would be reduced, lengthening the start-up time. Thus, in the present embodiment, a control unit 33 is pre-set with the starting procedures in terms of the conditions such as time. Just after the start the air extractor 17 starts operating, the change-over valve 24 closes, a change-over valve 25 opens and the drainage shut-off valve 10 closes in response to the signals supplied by the control unit 33 via signal lines 38, 33 and 40, thereby switching the destination of the drainage generated by the gland steam condenser 15 from the condenser tube bundle unit 2 to an exit drainage recovery line 23 of the gland steam condenser. This recovery line 23 may be connected to the outside of the plant or to a recovery device (not shown).

If the drainage from the gland steam condenser 15 is temporarily reserved in the recovery device, the influences upon the oxygen concentration are minimal, and moreover this drainage can be recovered to the system. The drainage is then introduced into the condenser 1 during normal running or is recovered directly into the water supply line 14 (see FIG. 7). Specifically, the condensate during normal running has a very low oxygen concentration and is most sufficient for the requirements for the steam generator so that tho amount of drainage from the gland steam condenser to be mixed is increased, enhancing the drainage recovery efficiency. If the recovery flow rate at this time is within the critical value, as illustrated in FIG. 6(*b*), there is no problem even if this drainage is recovered in mixture with the condensate. This recovery flow rate may be selected by setting it in advance or by controlling the flow rate.

After the preparations for the start have been completed by the procedures described above, as mentioned the air extractor 17 is started, to discharge the air from the tube bundle unit 2 via the air extracting line 18 to the outside of the condenser 1, thereby to generate the vacuum in the tube bundle unit 2. The pressure of the tube bundle unit 2 is metered by a pressure gauge 34, and the pressure of the hot well unit 3 is metered by a pressure gauge 35. These pressure signals are inputted via signals lines 36 and 37 to the control unit 33. When the pressures in the tube bundle unit 2 and the hot well unit 3 are substantially equal, the signal is sent from the control unit 33 via a signal line 41 to open the shut-off unit 4 to thereby connect the tube bundle unit 2 and the hot well unit 3. Under the pressure of the tube bundle unit 2 when the shut-off unit 4 is open, as illustrated in FIG. 6(*a*), the drainage introduced to the condenser 1 is de-aerated to the required reference value for the HRSG by the evacuation so that the quality of the condensate is not adversely affected even if the drainage of the gland steam condenser 15 is recovered to the condenser. Therefore, after the shut-off unit 4 has been opened, the change-over valve 25 is closed, and the change-over valve 24 is opened to recover the drainage to the condenser tube bundle unit 2. Then, the drainage is introduced via the down-comer 6 and the shut-off unit 4 to the hot well unit 3 and is mixed for recovery in the hot well 29. Since, at this time, the quality of the condensate of the hot well 29 is held within the permitted range for the steam generator, the change-over valve 27 is closed to interrupt the recirculation of the condensate, and the change-over valve 26 is opened to start the water supply to the steam generator. After this water supply to the HRSG, the circulation of water and steam is established for the normal running of the plant.

Figure 2:
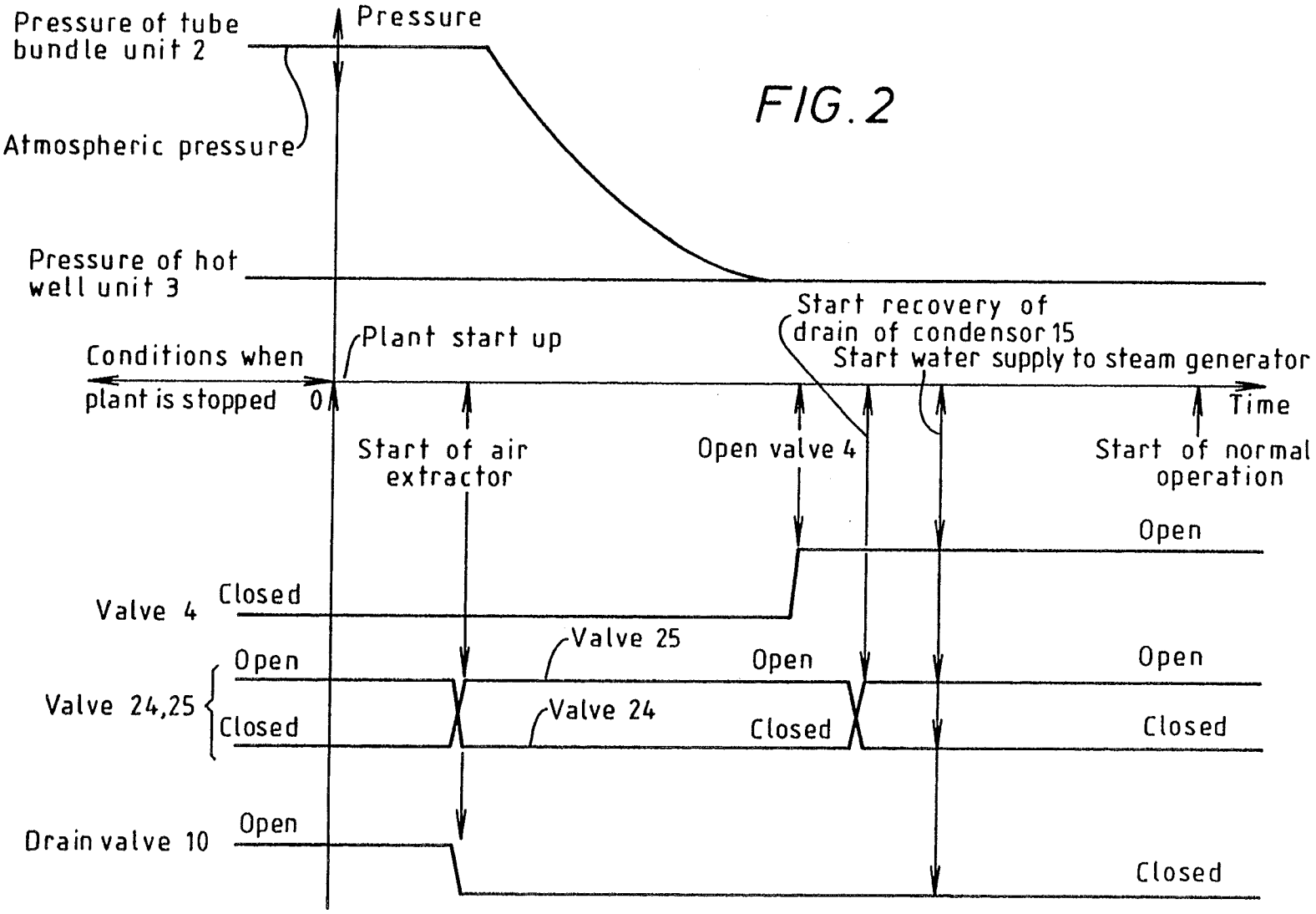
FIG. 2 is a control diagram for the condenser of FIG. 1, in a start-up period of the turbine plant.

FIG. 2 illustrates the operation as described above of the system shown in FIG. 1, specifically showing the pressures of the tube bundle unit 2 and the hot well unit 3, and the states of the shut-off unit 4, the change-over valves 24 and 25 and the drainage shut-off valve 10. The states of the shut-off unit 4, the change-over valves 24 and 25 and the drainage shut-off valve 10 are controlled by the signals which are produced by the control unit 33 by inputting the operations of the individual units and valves to the control unit 33. Control can also be achieved by a method of pre-setting the running procedures in relation to time and/or by reference to the signals which are produced by metering the pressure or other conditions of the tube bundle unit 2.

Other embodiments of the present invention will be described in the following. In these other embodiments, the condenser has the same basic construction and operation as that of the foregoing embodiment and will therefore not be fully described again. Parts having the same reference numbers in the drawings have the same or similar functions.

Figure 3:
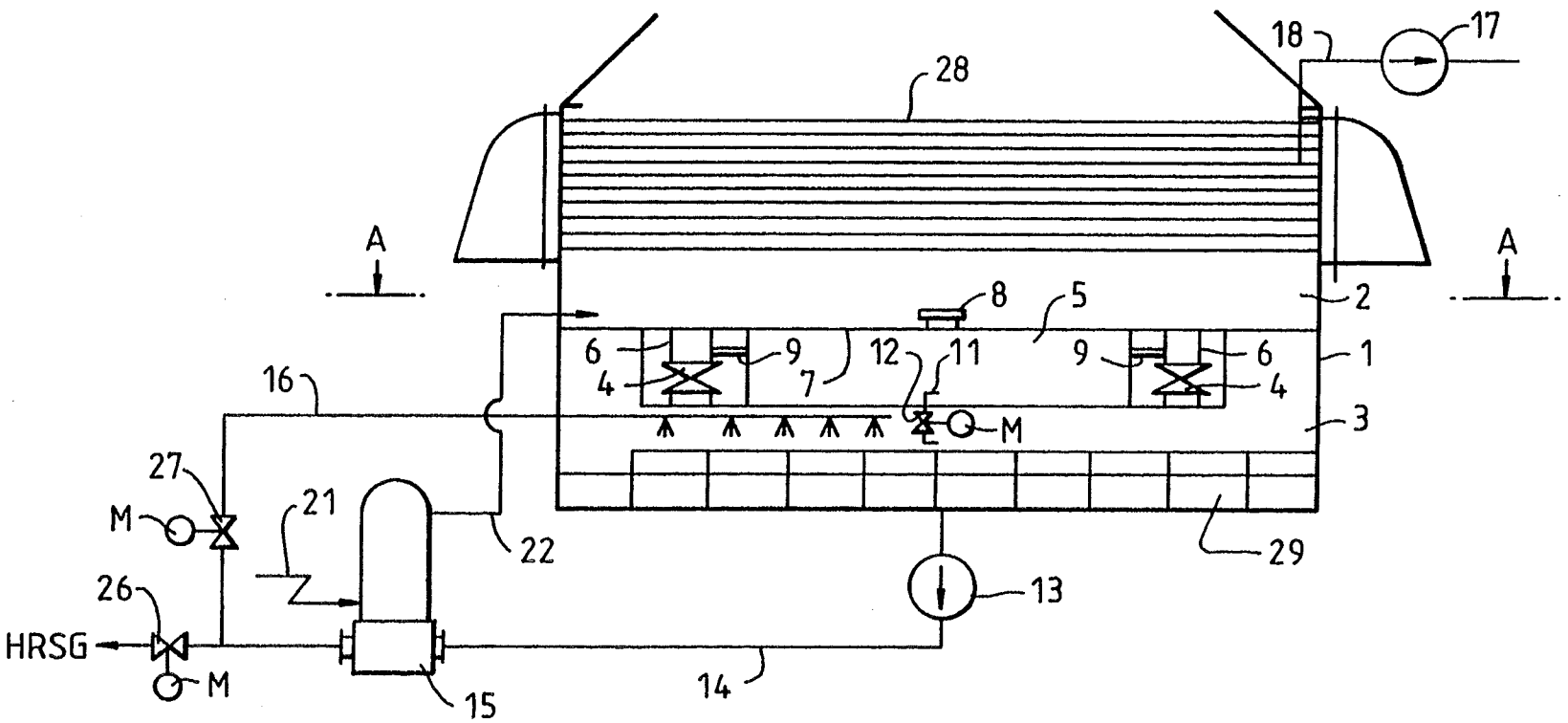
FIG. 3 is a diagrammatic view of a second condenser for a steam turbine plant, embodying the invention.
Figure 4A:
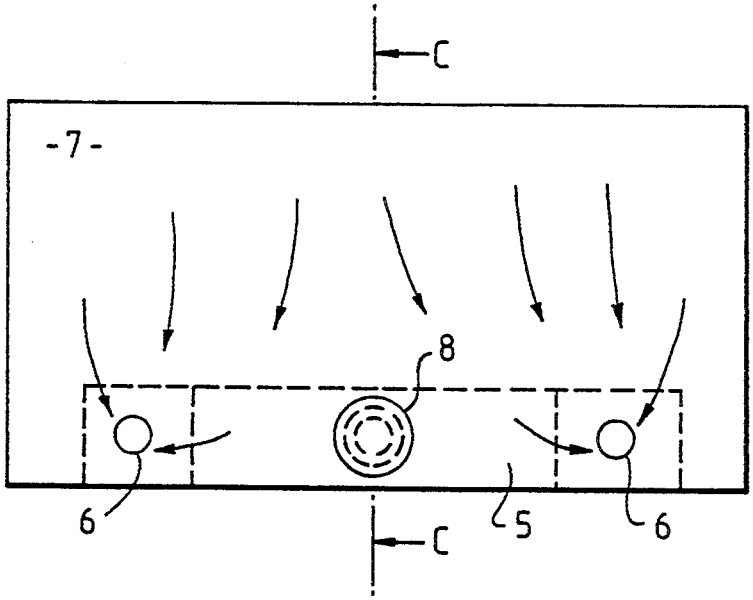
FIGS. 4(*a*), 4(*b*) and 4(*c*) are respectively a schematic top view, a schematic sectional view on line B—B of FIG. 4(*c*) and a schematic section on line C—C of FIG. 4(*a*), of the drainage reservoir and hot well of the condenser of FIG. 3.
Figure 4B:
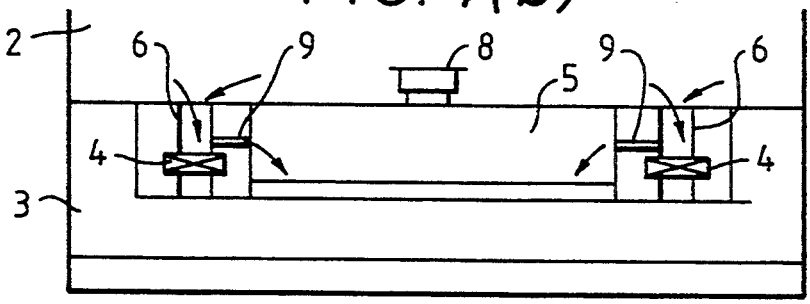
Figure 4C:
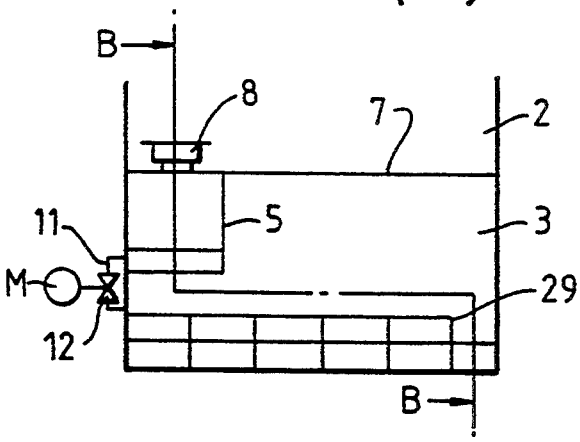

In the embodiment of FIGS. 3 and 4, the drainage of the gland steam condenser 15, which is generated in it at the initial stage after the start of the plant, is temporarily reserved in a drainage reservoir 5 formed in the main steam condenser 1 and constituting a de-aeration region. In this condenser, the residual drainage in the tube bundle unit 2 at stop of the plant is introduced via the two down-comers 6 and the drainage connecting pipes 9 into the drainage reservoir 5. At this time, a recovery shut-off valve 12 is closed so that the drainage is not mixed with the condensate in the hat well 29 via a drainage recovery pipe 11 and the recovery shut-off valve 12, which controls the communication between the drainage reservoir 5 and the hot well unit 3.

In more detail, as FIGS. 3 and 4 show, the drainage reservoir 5 for reserving the drainage temporarily is a chamber formed in the main steam condenser 1, and an equalizing port 8 for equalizing the pressure in the reservoir 5 with that of the tube bundle unit 2 is formed in a portion of its top cover, i.e. the partition 7 of the condenser. Due to the provision of that equalizing port 8, when the pressure $P_2$ (as illustrated in FIG. 5(*a*)) of the tube bundle unit 2 changes with the rise of vacuum caused by the air extractor 17 at start-up or with the vacuum breakage at stop of the plant, as illustrated in the individual pressure diagrams of FIG. 5, the pressure $P_5$ (as illustrated in FIG. 5(*c*)) of the drainage reservoir 5 changes with the change in the pressure $P_2$ of the tube bundle unit 2 so that the tube bundle unit 2 and the drainage reservoir 5 have their pressures equalized to each other. Incidentally, the pressure $P_3$ (as illustrated in FIG. 5(*b*)) of the hot well unit 3 is unchanged before and after start-up. As a result, the drainage introduced into the tube bundle unit 2 and residing on the partition 7 can be introduced at all times by gravity, when the shut-off units 4 are closed into the drainage reservoir 5 via the down-comers 6 and the drainage connecting pipes 9 branching from the down-comers 6. The equalizing port 8 stands up from the partition 7 and has a protruding flange at its top so that the condensate formed by the tube bundle unit 2 in normal running does not flow via the equalizing port 8 directly into the drainage reservoir 5 and thus does not accumulate in a large amount in the drainage reservoir 5. An air path is thus maintained from the reservoir 5 to the tube bundle unit 2. Therefore, the drainage in the drainage reservoir 5 need not be emptied before the shut-off unit 4 is closed for shut-down, so that the operation can be improved.

The shut-off units 4 thus act to select the route of the drainage flow to the hot well 29 or the drainage reservoir 5, and also when closed isolate the pressure in the hot well 29.

FIG. 4 gives schematic diagrams of the drainage reservoir 5 and illustrates the flows of the drainage from above the partition 7 into the drainage reservoir 5 by arrows. FIG. 4(*a*) is a plan view showing the condenser partition 7 which has the two down-comers 6 and the equalizing port 8. As mentioned, the equalizing port 8 protrudes from the upper face of the partition 7 so that the drainage may not flow thereinto, but the down-comers 6 are formed to receive the drainage. FIG. 4(*c*) is a section which shows that the drainage reservoir 5 is formed between the partition 7 and the hot well 29 by making use of the space in the hot well unit 3, and its communication with the hot well 29 is suitably controlled by the recovery shut-off valve 12.

As illustrated, the drainage accumulating on the partition 7 is always introduced by gravity, when the shut-off unit 4 is closed, via the down-comers 6 and the drainage connecting pipes 9 branching from the down-comers 6 into the drainage reservoir 5.

At the start-up of the plant, the drainage generated during an initial period in the gland steam condenser 15 is introduced without any power into the tube bundle unit 2 of the condenser 1 by making use of the pressure difference and the head difference. Since at this time the shut-off units 4 are closed to prevent communication between the tube bundle unit 2 and the hot well unit 3, the drainage is temporarily reserved in the drainage reservoir 5 via the down-comers 6 and the drainage connecting pipes 9. The drainage thus temporarily reserved in the drainage reservoir 5 is introduced during normal running via the drainage recovery pipe 11 into the hot well unit 3 by opening the recovery shut-off valve 12. This introduction exerts the least influence upon the oxygen concentration in the water in the well unit 3 and is a most suitable manner for the in-system recovery of the drainage.

Specifically, the condensate in the hot well unit 3 in normal running has an extremely low oxygen concentration and the highest margin below the reference value for the HRSG, so that the amount of drainage mixed into it can be increased to enhance the drainage recovery efficiency. The recovery flow rate at this time may be that of the mixture of the drainage and the condensate if the recovery is within the critical recovery flow rate. This recovery flow rate may be adjusted either by setting it in advance or by controlling the flow rate.

After the preparations for start-up have been completed by the procedure described above, the air extractor 17 is started, with the hot well unit 3 maintained under vacuum, to discharge the air of the tube bundle unit 2 to the outside of the condenser 1 via the air extracting line 18 to thereby raise the vacuum of the tube bundle unit 2. When the pressures in the tube bundle unit 2 and the hot well unit 3 are substantially equal, the two shut-off units 4 are opened to connect the tube bundle unit 2 and the hot well unit 3. At the pressure of the tube bundle unit 2, as illustrated in FIG. 6*a*, the introduced drainage in the reservoir is de-aerated towards the reference value of oxygen concentration for of the steam generator by the evacuation so that the quality of the condensate is not influenced even if the drainage of the gland steam condenser 15 is recovered to the condensate. After the shut-off units 4 have been opened, therefore, the drainage of the gland steam condenser 15 is introduced from the tube bundle unit 2 via the down-comers 6 and the shut-off units 4 into the hot well unit 3 to be mixed into the condensate and recovered. Since, at this time, the quality of the condensed water in the hot well 29 is maintained within the limit value for the HRSG, the change-over valve 27 is closed to interrupt the recirculation of the condensate, and the change-over valve 26 is opened to begin the water supply to the HRSG. After this, the water and steam circulations are continued for normal running of the plant.

In the present embodiment, too, the running procedures and the states of the shut-off units 4, the recovery shut-off valve 12 and the change-over valves 26 and 27 are definable so that their opening and closing operations can be controlled in response to signals coming from the control unit by inputting the operations of the individual devices and valves. Moreover, the operations can be controlled either by setting the running procedures in terms of time or by means of signals which are obtained by metering the pressure of the tube bundle unit 2, etc.

Incidentally, similar effects can be obtained with respect to the maintenance of the water quality even if the drainage recovered to the drainage reservoir 5 is not recovered to the hot well 29 but is discharged to the outside of the system.

Figure 7:
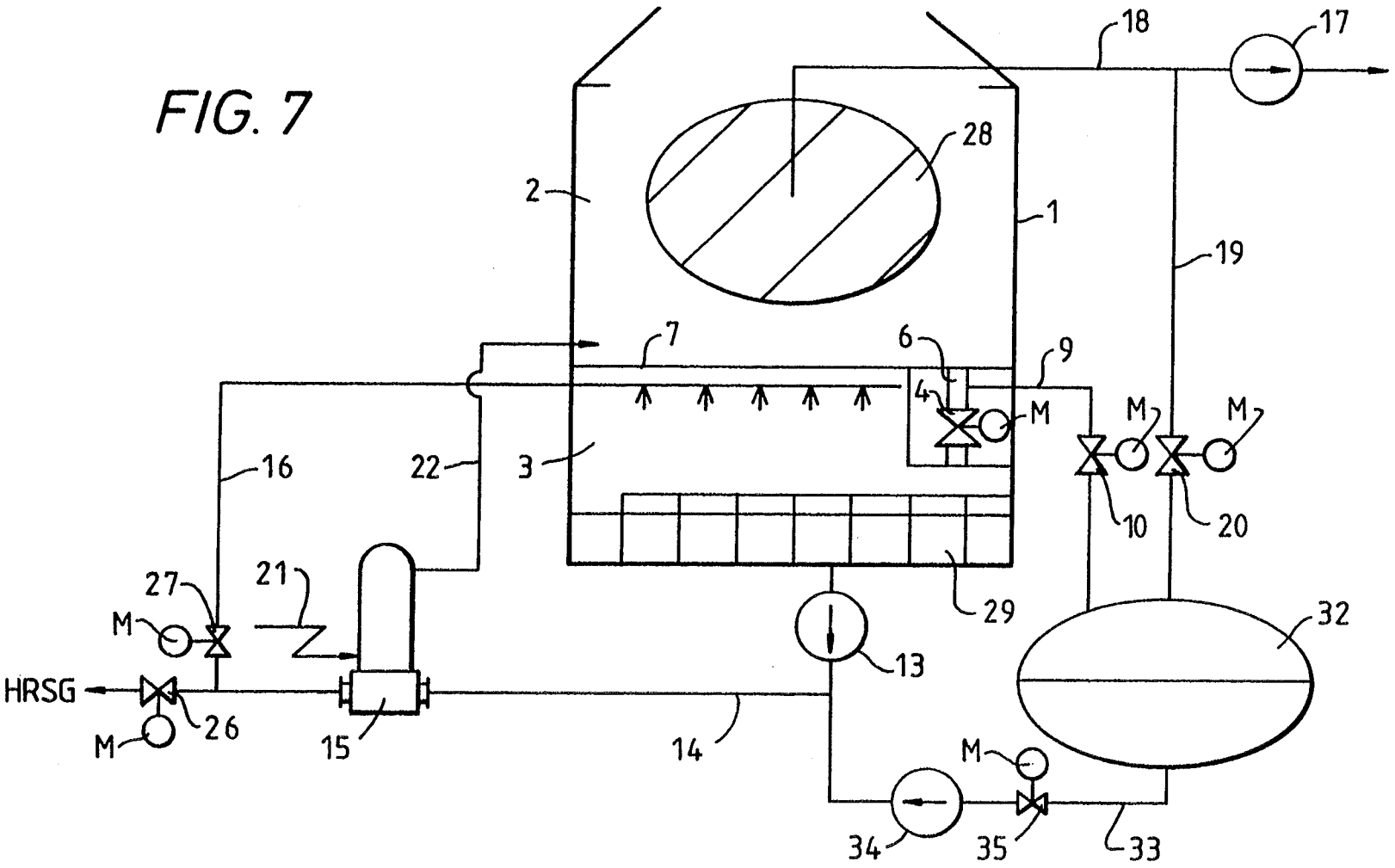
FIG. 7 is a diagrammatic view of a third condenser for a steam turbine plant embodying the invention.
Figure 8:
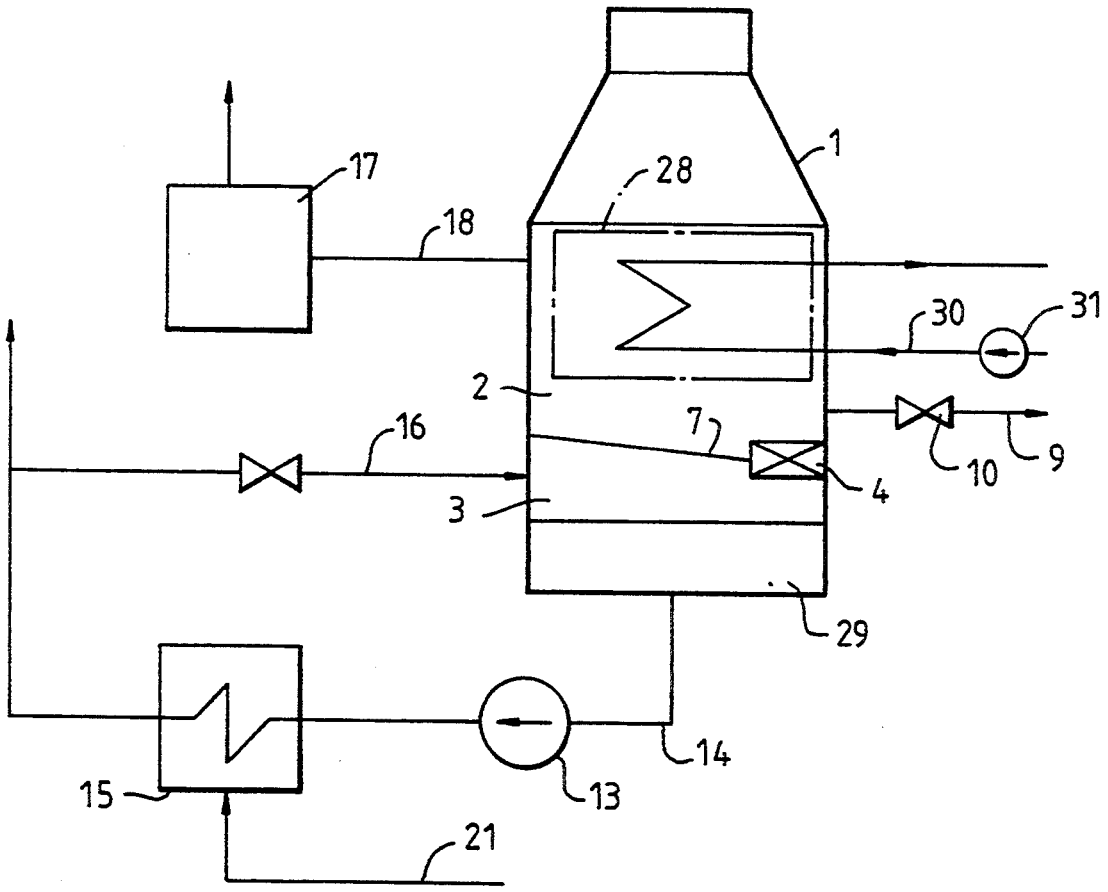
FIG. 8 PRIOR ART
FIG. 8 is a diagrammatic view of a condenser construction of the prior art.

Another embodiment of the present invention will now be described with reference to FIG. 7. In this embodiment, the drainage from the gland steam condenser is introduced into the condenser tube bundle unit 2 and then passes to a recovery unit 32 constituting a de-aeration reservoir, which is disposed outside the condenser 1, via the down-comer 6, the drainage connecting pipe 9 and the drainage shut-off valve 10, to be temporarily reserved. Residual drainage in the tube bundle unit 2 at shut-down is also passed via the down-comer 6 and the drainage connecting pipe 9 into the recovery unit 32. At this time, the drainage shut-off valve 10 for connecting and disconnecting the tube bundle unit 2 and the recovery unit 32 is open. At the start of the plant, e.g. the next day, vacuum in the tube bundle unit 2 and the recovery unit 32 can be simultaneously raised on start of the air extractor 17 by an equalizing pipe 19 having an equalizing shut-off valve 20 and connecting into the air extracting line 18, so that the tube bundle unit 2 and the recovery unit 32 have their pressures equalized. As a result, when the shut-off unit 4 is closed, the drainage collecting on the partition 7 is guided at all times by gravity via the down-comer 6 and the drainage connecting pipe 9 branching therefrom and is reserved in the recovery unit 32.

The drainage thus temporarily reserved in the recovery unit 32 may be directly recovered during normal running to the condenser 1 or as shown to the water supply line 14 via a line 33 having a pump 34 and a valve 35. This direct recovery can be controlled to influence the oxygen concentration of the condensate as little as possible and achieves in-system recovery of the drainage.

Specifically, the main steam condensate during normal running has an extremely low oxygen concentration and the highest margin relative to the reference value for the HRSG so that the amount of drainage to be mixed into it can be increased to enhance the drainage recovery efficiency. The recovery flow rate at this time may be that of the mixture of the drainage and the condensate if the recovery is within the critical recovery flow rate. This recovery flow rate may be adjusted either by setting it in advance or by controlling the flow rate.

After the preparations for the start-up have been completed by the procedure described, the air extractor 17 is started, with the hot well unit 3 maintained under vacuum, to discharge the air of the tube bundle unit 2 to the outside of the condenser 1 via the air extracting line 18 thereby to raise the vacuum of the tube bundle unit 2. When the pressures in the tube bundle unit 2 and the hot well unit 3 are substantially equal, the shut-off unit 4 is opened to connect the tube nest unit 2 and the hot well unit 3. Under the pressure of the tube bundle unit 2, as illustrated in FIG. 6, the introduced drainage in the reservoir 32 is de-aerated towards the reference value for the HRSG by the evacuation so that the quality of the condensate is not significantly influenced even if the condensed drainage of the gland steam condenser 15 is recovered to the condenser 1.

After the shut-off unit 4 has been opened, therefore, the drainage generated in the gland steam condenser 15 is introduced from the condenser tube bundle unit 2 via the down-comer 6 and the shut-off unit 4 into the hot well unit 3 so that it is mixed into the hot well 29 and recovered. Since, at this time, the quality of the condensed water of the hot well 29 is held within the limit value for the HRSS, the change-over valve 27 is closed to interrupt the recirculation of the condensed water, and the change-over valve 26 is opened to begin the water supply to the HRSG. After the start of this water supply to the HRSG, the water and steam circulations are continued for normal running.

In this embodiment, too, the running procedures and the states of the various valves can be controlled by signals from a control unit.

To summarize, the present invention can prevent the deterioration of the hot well water quality, which might otherwise be caused by the drainage during the plant start-up, making it possible to reduce the plant start-up time period considerably and reducing or eliminating the auxiliary power such as the heated steam which has been consumed for de-aeration in the prior art. Moreover, economical plant running can be achieved by recovering the drainage to the slant.

What is claimed is:

1. A condenser for condensing the driving steam of a steam turbine, having:

a) a tube bundle for condensing said driving steam by heat exchange;

b) a drainage region below said tube bundle;

c) a hot well for holding the condensate of said driving steam from said tube bundle;

d) means for feeding said condensate from said hot well to a steam generator for said turbine;

e) a reservoir separated from said hot well for holding a body of drain from said drainage region; and f) means for establishing flow of drainage from said drainage region to said hot well and said reservoir selectively and for pressure-isolating said hot well from said drainage region.

2. A condenser according to claim 1 wherein said means for selectively establishing flow and for pressure isolating comprises a conduit for flow of drainage from said drainage region to said hot well, by-passing said reservoir, and valve means for closing said conduit.

3. A condenser according to claim 1 wherein said reservoir is arranged above said hot well and is separated from said drainage region by a partition.

4. A condenser according to claim 1 wherein said reservoir is connected to said drainage region by an air flow passage for maintaining said reservoir and said drainage region at substantially equal pressures.

5. A condenser according to claim 1 further having a conduit for flow of drainage from said reservoir to said hot well and valve means for controlling flow therein.

6. A condenser according to claim 1 having means for controllably feeding a flow a drainage from said reservoir to said steam generator.

7. A condenser according to claim 1 having means for subjecting said reservoir to reduced pressure, to effect de-aeration of water therein.

8. A condenser for a steam turbine driven by steam from a boiler, which condenser has a tube bundle for condensation of driving steam of said turbine, a drain region below said tube bundle, a hot well for accumulation of condensate from said tube bundle, a de-aeration region separated from said hot well for storing a body of drain formed by condensation of steam, means for establishing a flow of drain from said drain region to said hot well by-passing said de-aeration region, and means for feeding said body of drain from said de-aeration region to one of said hot well and said boiler.

* * * * *